United States Patent [19]

Dull et al.

[11] Patent Number: 4,989,741

[45] Date of Patent: Feb. 5, 1991

[54] NESTABLE AND TRANSPORTABLE CLOSED CHEMICAL HANDLING SYSTEM

[75] Inventors: Lawrence C. Dull, Greensboro; Patrick T. Jackson, High Point, both of N.C.

[73] Assignee: Ciba-Geigy Corporation, Ardsley, N.Y.

[21] Appl. No.: 463,926

[22] Filed: Jan. 8, 1990

Related U.S. Application Data

[63] Continuation of Ser. No. 227,246, Aug. 2, 1988, abandoned.

[51] Int. Cl.[5] ..... B65D 21/02

[52] U.S. Cl. ..... 220/1.65; 206/509; 206/512; 220/85 P; 220/606; 220/661; 220/675

[58] Field of Search ..... 220/1.5, 69, 70, 85 P; 206/509, 511, 512

[56] References Cited

U.S. PATENT DOCUMENTS

| | | | |
|---|---|---|---|
| 2,793,788 | 5/1957 | Lysne | 220/69 |
| 3,084,830 | 4/1963 | Koelsch | 206/509 |
| 3,406,885 | 10/1968 | McKechnie | 220/1.5 |
| 3,446,394 | 5/1969 | Miller | 206/511 |
| 3,493,128 | 2/1970 | Silvert | 206/509 |
| 3,963,144 | 6/1976 | Berwald | 220/85 P |
| 3,971,491 | 7/1976 | Mowaff | 220/69 |
| 4,055,273 | 10/1977 | Jones | 220/20 |
| 4,496,270 | 1/1985 | Miller | 206/511 |
| 4,678,084 | 7/1987 | Maker | 206/511 |

FOREIGN PATENT DOCUMENTS

| | | | |
|---|---|---|---|
| 2136946 | 2/1973 | Fed. Rep. of Germany | 220/69 |
| 1093924 | 5/1955 | France | 206/511 |
| 1535656 | 7/1968 | France | 206/509 |
| 732366 | 6/1955 | United Kingdom | 206/509 |

*Primary Examiner*—George F. Lowrance

*Attorney, Agent, or Firm*—Wenderoth, Lind & Ponack

[57] ABSTRACT

A fluid handling system includes chemical handling tanks which are relatively stable and difficult to tip over, are farmer hoistable in that such can be lifted with flexible hoisting line securely received around the tanks, and are readily stackable for storage thereof. Each tank includes a generally hollow body portion and a supporting portion integral with the body portion. The supporting portion includes a base and a tip-over-preventing portion for preventing the tank from tipping over when the tank is tilted laterally about the base. The supporting portion also includes grooves extending therein which flexible hoisting lines can be securely received for allowing the tanks to be transported. The supporting portion is also designed to accommodate the fork of a forklift. The tanks are also stackable and are nested via ribs projecting from the top portion of tanks and grooves defined at the underside of the tanks. Furthermore, a central recess is formed in the supporting portion at the top thereof and allows a pump to be entirely received therein.

26 Claims, 8 Drawing Sheets

NESTABLE AND TRANSPORTABLE CLOSED CHEMICAL HANDLING SYSTEM

This application is a continuation of now abandoned application, Ser. No. 07/227,246 filed on Aug. 2, 1988.

BACKGROUND OF THE INVENTION

1. Field of the Invention

The present invention relates to fluid handling systems, and in particular, refillable chemical handling tanks from which chemicals such as herbicides can be delivered.

2. Description of the Related Art

Known chemical handling tanks from which chemicals, such as herbicides, can be delivered are widely employed throughout the farming industry.

Such conventional chemical handling tanks when resting on a supporting surface extend vertically and as such, have a relatively high center of gravity. Accordingly, these conventional chemical handling tanks are apt to tip over. To prevent the tanks from tipping over, non-skid pallets adapted to support the tanks are used for stably supporting the tanks.

However, even when the aforementioned chemical tanks are supported on such pallets, another disadvantage associated with their extending generally vertically is that when such pallets are lifted by forklifts during transport of the tanks, the visibility of the forklift operator is impaired by the tanks.

Finally, a further disadvantage of conventional chemical handling tanks is that they can not be stacked for storage, especially when full and when respective pumps are connected thereto for delivering the chemicals from the tanks.

SUMMARY OF THE INVENTION

Accordingly, it is an object of the present invention to overcome the drawbacks associated with the instability of the conventional chemical handling tanks by providing a liquid handling system, and in particular a chemical handling tank, which is stable when supported and which will not tip over easily.

To achieve the above-described object of the present invention, a chemical handling tank of the present invention has a generally horizontal configuration with a relatively low center of gravity when resting on a supporting surface via a base portion thereof and tip-over-preventing means for preventing the tank from tipping over when the tank is tilted about the base portion.

It is another object of the present invention to overcome the drawbacks associated with the requirement of a pallet for transporting the conventional chemical handling tanks by providing a chemical handling tank that can easily be transported by chains, straps, cable or the like (hereinafter referred to as flexible hoisting lines) which are readily securable thereto. To achieve this object, the chemical tank according to the present invention has a grooved portion extending therein at each side thereof and in which the flexible hoisting lines are securely received so as to enable the tank to be transported by, for example, hoisting the flexible hoisting lines.

In the furtherance of this object, the chemical handling tank according to the present invention is also designed to facilitate conventional transport thereof by a forklift.

Finally, it is another object of the present invention to provide a liquid handling system that is readily storable and accessible by providing chemical handling tanks that are stackable even when pumps are operatively connected thereto, and in which the pumps are accessible when the tanks are stacked.

To achieve this object of the present invention, the chemical handling tanks according to the present invention each have at least one groove open, at a respective location to the underside of the tank and a rib projecting from the top of the tank above each said respective location. Therefore, when two tanks are stacked, each rib of the lower tank extends into the groove open at the underside of the upper tank whereby the tanks are nested securely. Furthermore, each rib of the tank extends from a supporting portion of the tank formed on the top of the tank. The supporting portion has a central recess at the bottom of which is located a pump mounting assembly through which a pump can deliver fluid from the tank. The pump can be entirely received in the central recess so as not to create any interference when the tanks are stacked. Furthermore, at least one respective side recess extends between the central recess and a side of the tank so that the pump may be accessed through the side recess when the tanks are stacked.

BRIEF DESCRIPTION OF THE DRAWINGS

The present invention, advantages and further objects thereof, will be better understood by those of ordinary skill in the art after reviewing the following detailed description of the preferred embodiments of the present invention referring to the accompanying drawings, in which.

It is to be noted that throughout the drawings, like reference numerals refer to like elements.

DETAILED DESCRIPTION OF THE PREFERRED EMBODIMENTS

Figure 1:
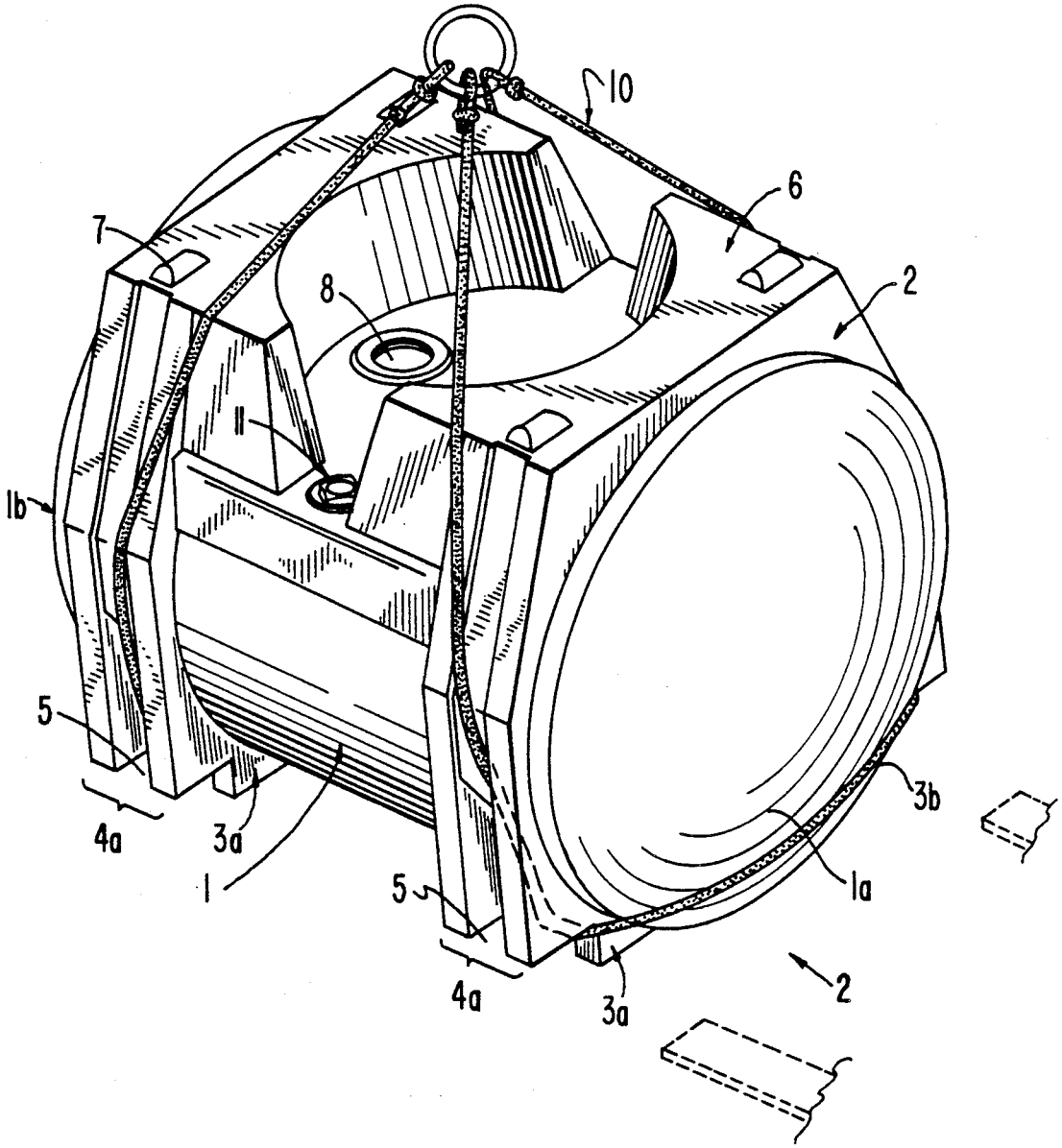
FIG. 1 is a perspective view of a first embodiment of a chemical handling tank according to the present invention illustrating alternative transport modes thereof.

Referring now to the drawings, and in particular to FIGS. 1–4 illustrating a first embodiment of a chemical handling tank according to the present invention, the chemical handling tank comprises a hollow body portion generally indicated at 1 and a supporting portion 2 integral with the body portion.

Figure 3:
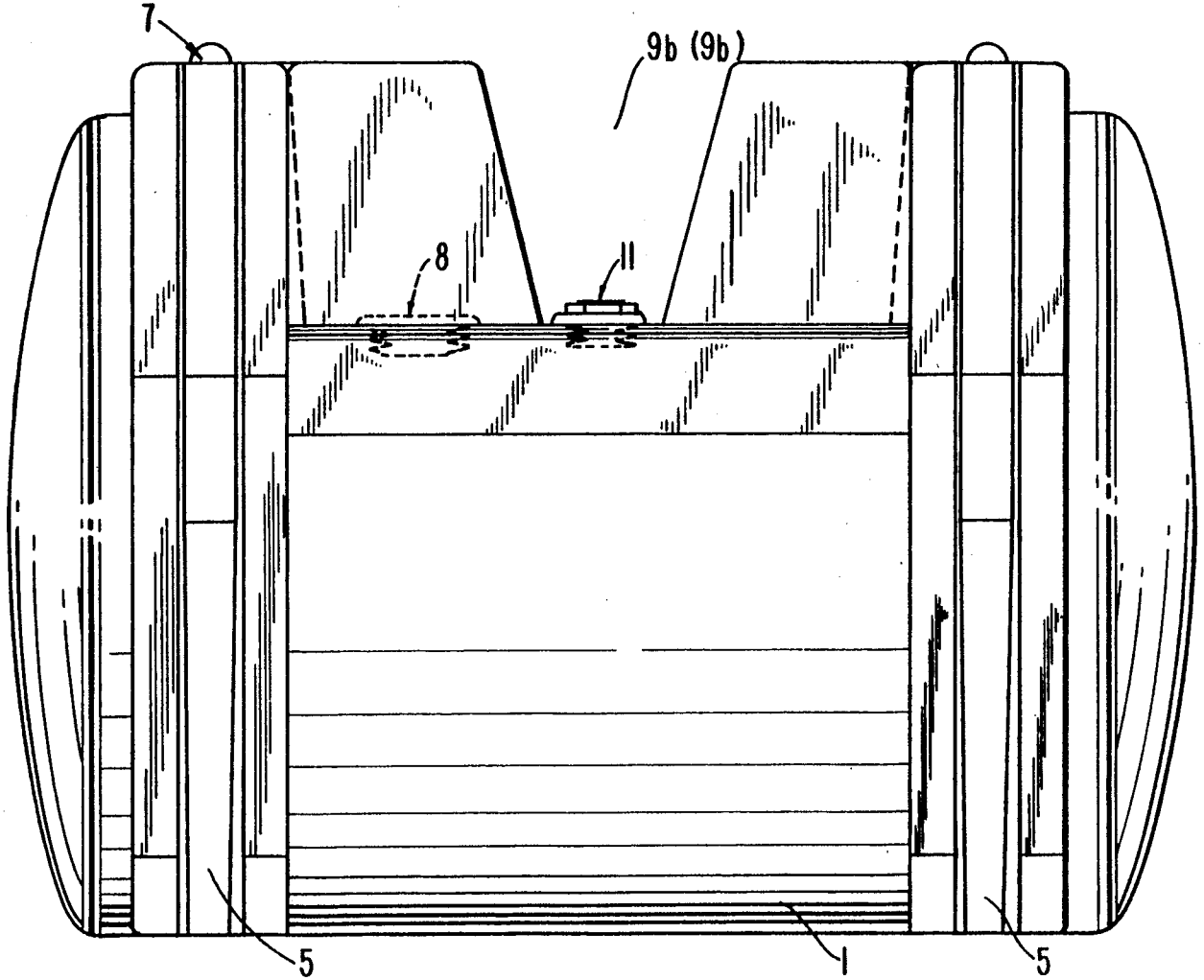
FIG. 3 is a front view of the first embodiment.
Figure 4:
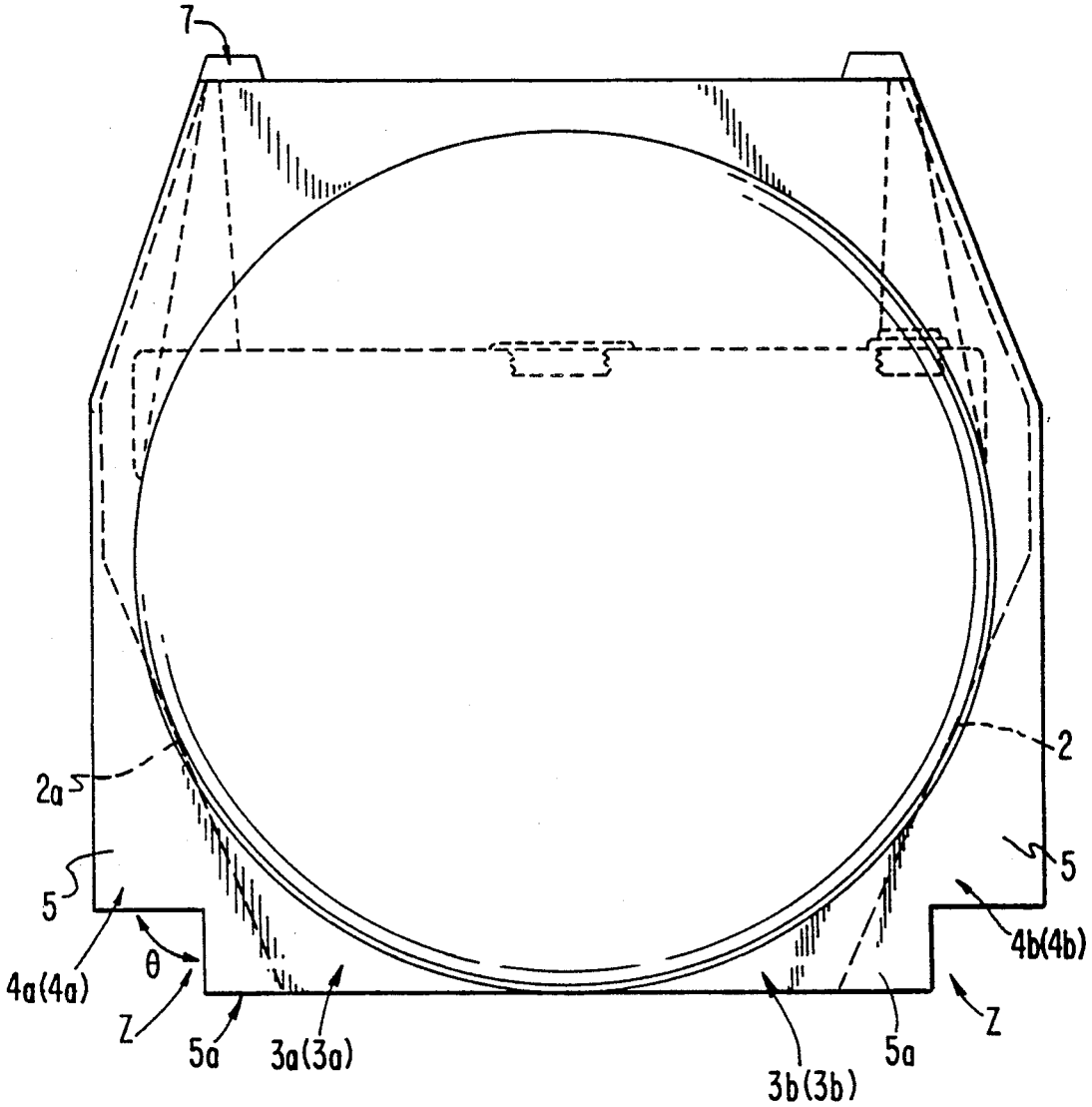
FIG. 4 is an end view of the first embodiment.
Figure 7:
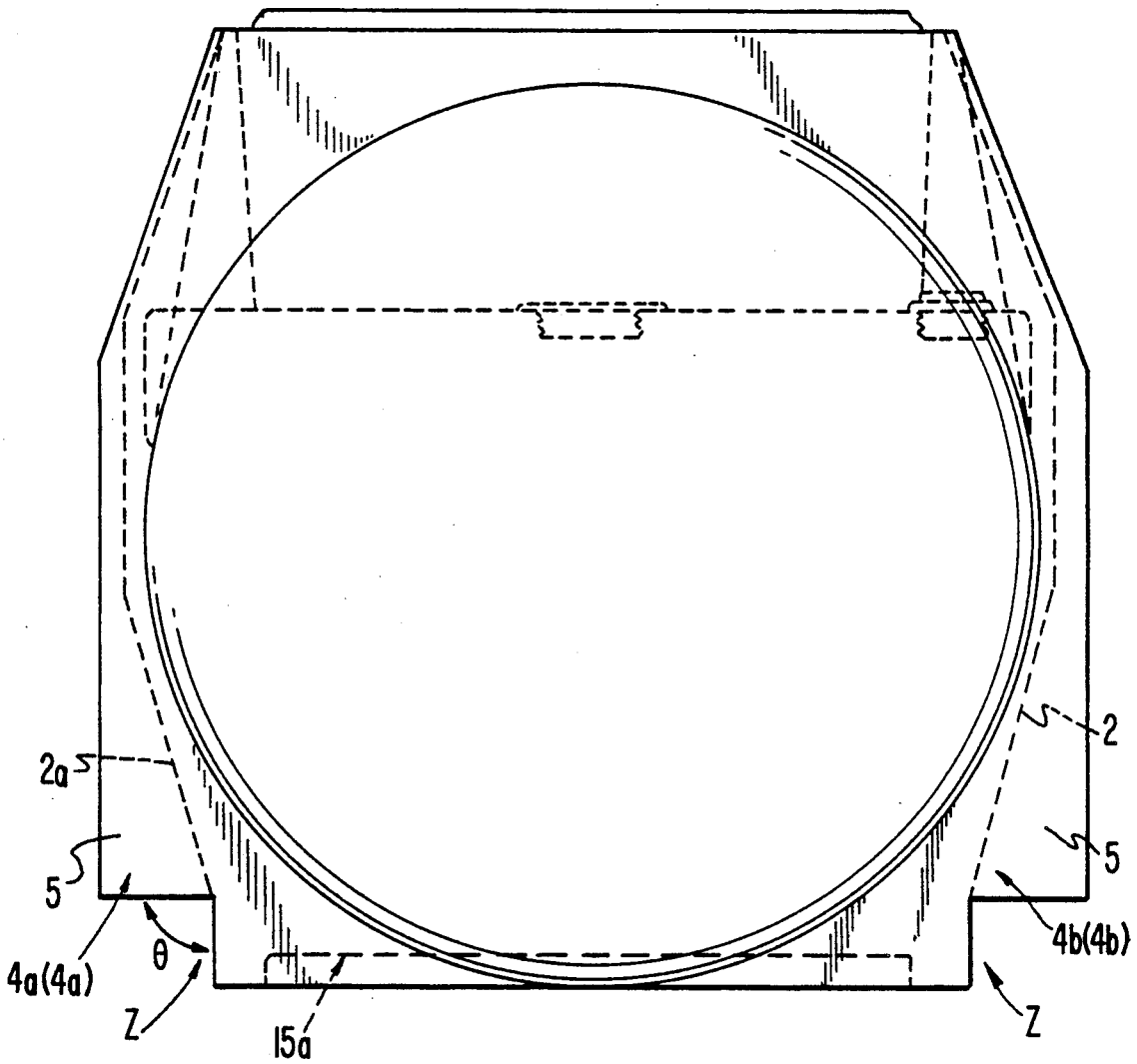
FIG. 7 is an end view of the second embodiment.

As seen in FIGS. 1 and 4, the supporting portion 2 includes a base 3*a*, 3*b* which rests on a supporting surface to support the body portion 1 thereon. The base 3*a*, 3*b* extends laterally with respect to and to each side of the longitudinal axis of the hollow body portion 1. Furthermore, the supporting portion 2 includes a respective tip-over-preventing portion 4*a*, 4*b* that extends laterally with respect to the longitudinal axis of the body portion from the base 3*a*, 3*b* and at a predetermined angle $\theta$ from the base 3*a*, 3*b*, respectively. In the preferred embodiment, as shown in FIGS. 3 and 7, angle $\theta$ is 90°. The function of each tip-over-preventing portion 4a, 4b is to prevent the tank from tipping over when the tank is tilted laterally about the base 3a, 3b while resting on the supporting surface by coming into contact with the supporting surface.

The angle $\theta$ and the lateral extent of each tip-over-preventing portion 4a, 4b is selected so that two recesses Z defined between the tip-over-preventing-portions 4a, 4b and the base 3a, 3b are able to accommodate the fork (illustrated by phantom lines in FIG. 1) of a forklift therein and so that the tip-over-preventing portions adequately prevent the tank from being tipped over.

Also, as is clear from FIG. 3, the tank has a relatively low center of gravity. In other words, the center of gravity is located at a predetermined distance from the supporting surface that is less than half the length of the tank as taken along the longitudinal axis of the body portion. Accordingly, the chemical handling tank of the present invention is relatively stable when full and is very difficult to tip over due to the aforementioned tip-over-preventing portions 4a, 4b.

According to the specific construction of the chemical handling tank according to the first embodiment of the present invention, the base 3a, 3b comprises a pair of base portions 3a, 3b and 3a, 3b spaced apart from one another along the longitudinal axis of the body portion while respective tip-over-preventing portions 4a and 4b extend from each of the base portions 3a, 3b and 3a, 3b on each side of the longitudinal axis, respectively. The chemical handling tank can comprise polyethylene and may have either a 110 gallon or 140 gallon capacity.

The chemical handling tank according to the present invention is also "farmer hoistable" meaning that it can be lifted with flexible hoisting line 10 fitted around the tank in the manner shown in FIG. 1. More specifically, the supporting portion 2, and in particular each tip-over-preventing portion 4a, 4b, has at least one groove 5 extending therein and open to a respective side of the tank whereby at least one grooved portion extends on each side of the tank for securely receiving the flexible hoisting line 10 to allow the tank to be transported thereby.

Figure 2:
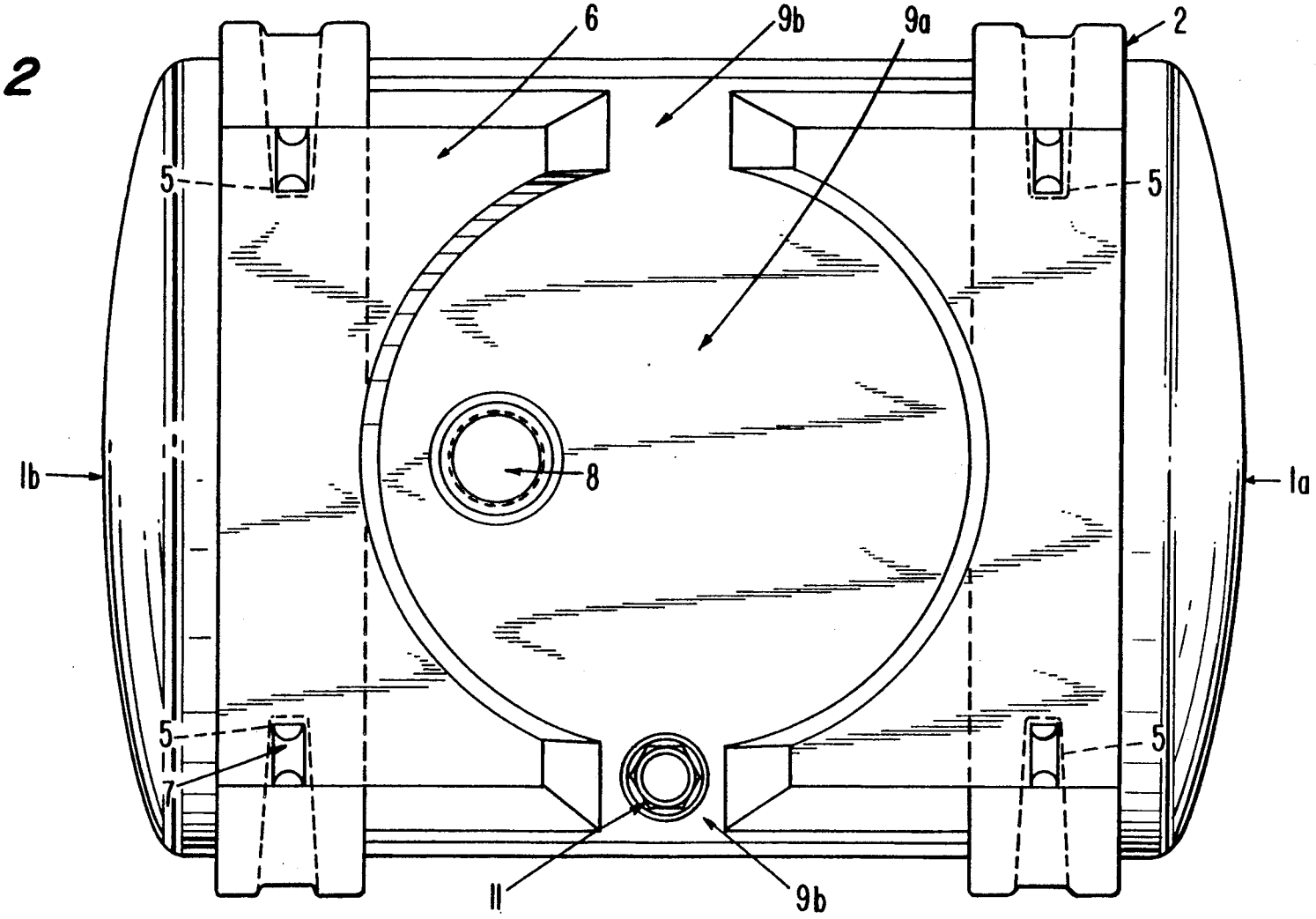
FIG. 2 is a top view of the first embodiment of the present invention.

Again, according to the specific construction of the present invention, and specifically referring to FIG. 2, the supporting portion has a pair of grooves 5, 5 extending therein adjacent each of the ends 1a, 1b of the hollow body portion. Each of the pair of grooves 5, 5 is located on a respective side of the tank and extends in a plane generally perpendicular to the longitudinal axis of the hollow body portion 1 of the tank. Referring now to FIG. 4, at least a portion of each of the grooves 5 has the bottom thereof defined by respective surfaces 2a of the supporting portion that extend inwardly toward the underside of the tank and obliquely with respect to the longitudinal axis of the hollow body portion. Such a construction allows the tank to be lifted in a cradle-like manner by the flexible hoisting line fitted therein.

And, as briefly mentioned above, the recesses Z provide locations at which a fork of a forklift may support the tank to transport the same. More specifically, the fork may be inserted into the recesses Z in a direction y while the tank rests on a supporting surface when the tank is to be transported as an alternative to hoisting the tank with flexible hoisting line 10.

Accordingly, it is seen that the supporting portion 2, in addition to having the base 3a, 3b and the tip-over-preventing portion 4a, 4b which contribute to the stability of the tank, also facilitates the transport of the tank due to the transport grooves 5 extending therein.

The supporting portion 2 also facilitates nesting of the tanks when the tanks are stacked. In this respect, according to the first embodiment of the present invention, the grooves 5 extending in the supporting portion 2 are each open, at a respective location 5a as illustrated in FIG. 4, to the underside of the tank. Respective ribs 7 project from an upper portion 6 of the supporting portion 2 directly above each respective location 5a. Each groove 5 has a width at said respective location 5a that is approximately the same as the width of the respective rib 7 extending thereabove. Accordingly, when respective ones of the tanks are stacked, each rib of a lower one of the stacked tanks extends into a respective groove 5 of an upper one of the stacked tanks whereby the tanks are securely nested when stacked.

Figure 5:
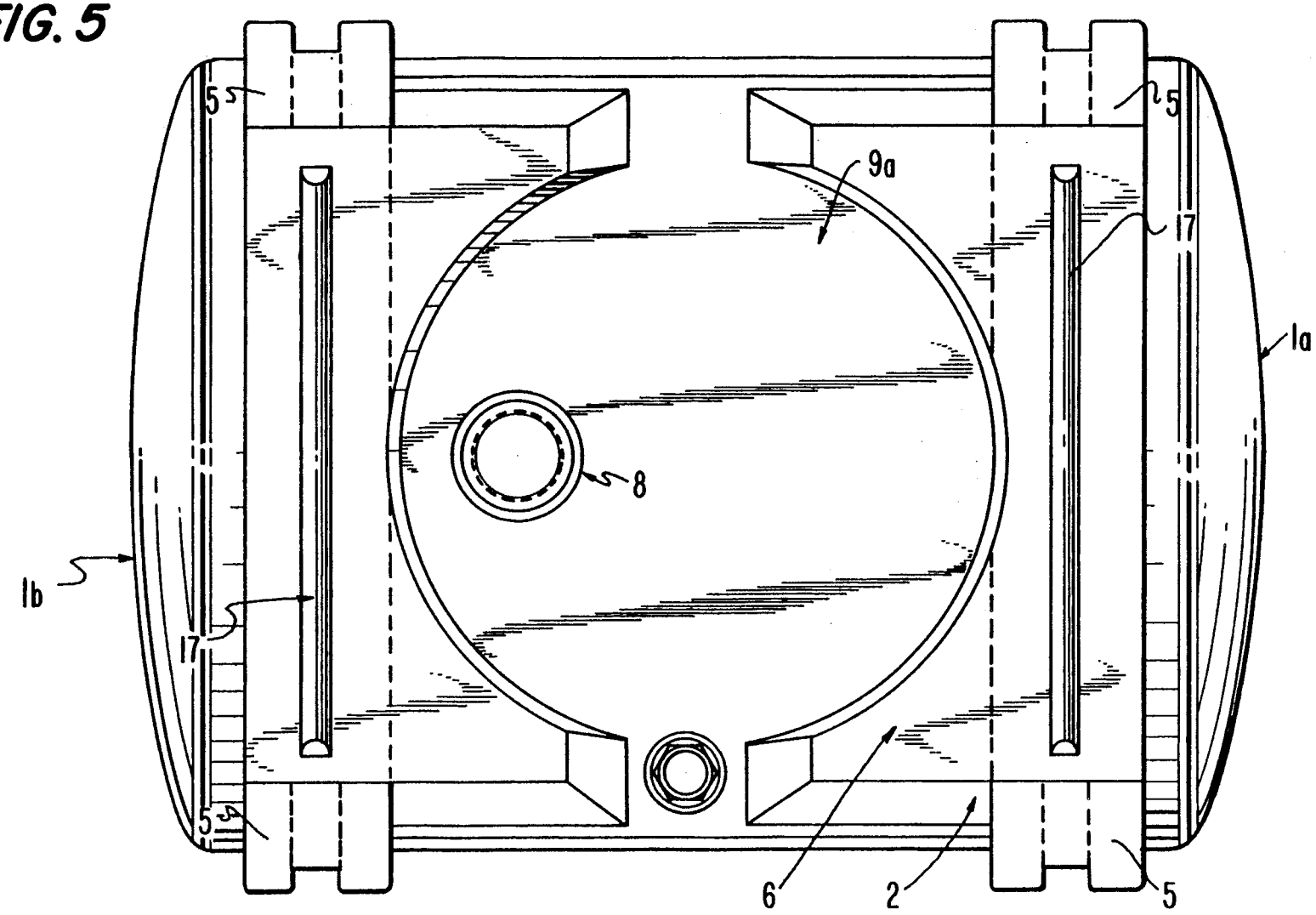
FIG. 5 is a top view of a second embodiment of a chemical handling tank according to the present invention.
Figure 6:
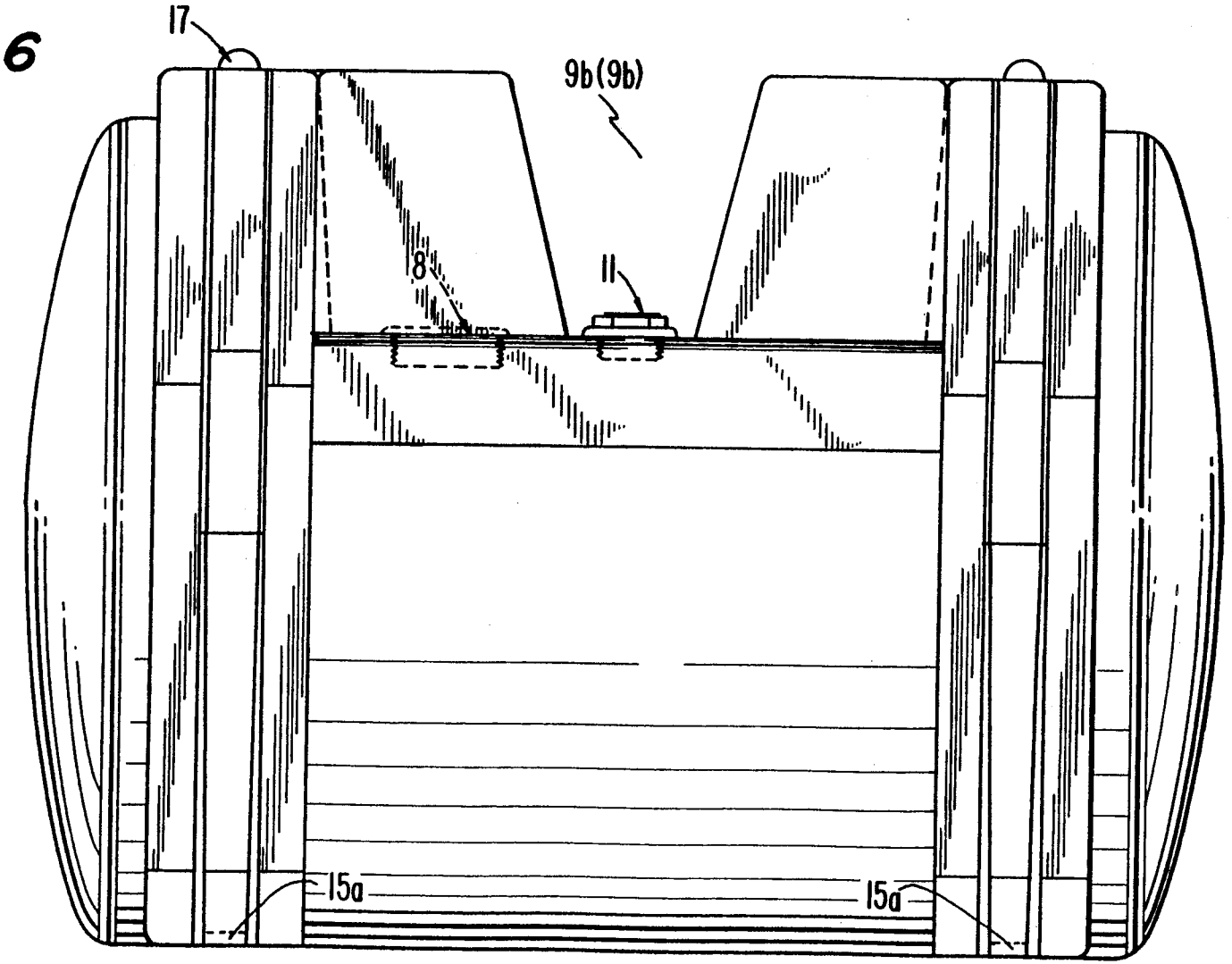
FIG. 6 is a front view of the second embodiment.

The second embodiment of the present invention as shown in FIGS. 5–7 is essentially the same as the first embodiment except that while the ribs 7 in the first embodiment extend into grooves open to the underside of the tank at locations 5a that are disposed lateral to each base portion 3a, 3b, the ribs 17 of the second embodiment of the present invention extend into respective grooves 15a that are formed in the base portions 3a, 3b and 3a, 3b. Accordingly, as is quite evident from FIGS. 5–7, when the tanks of the second embodiment are to be stacked, each respective rib 17 extends into a groove 15a thereby securely nesting the tanks when the tanks are stacked.

Figure 8:
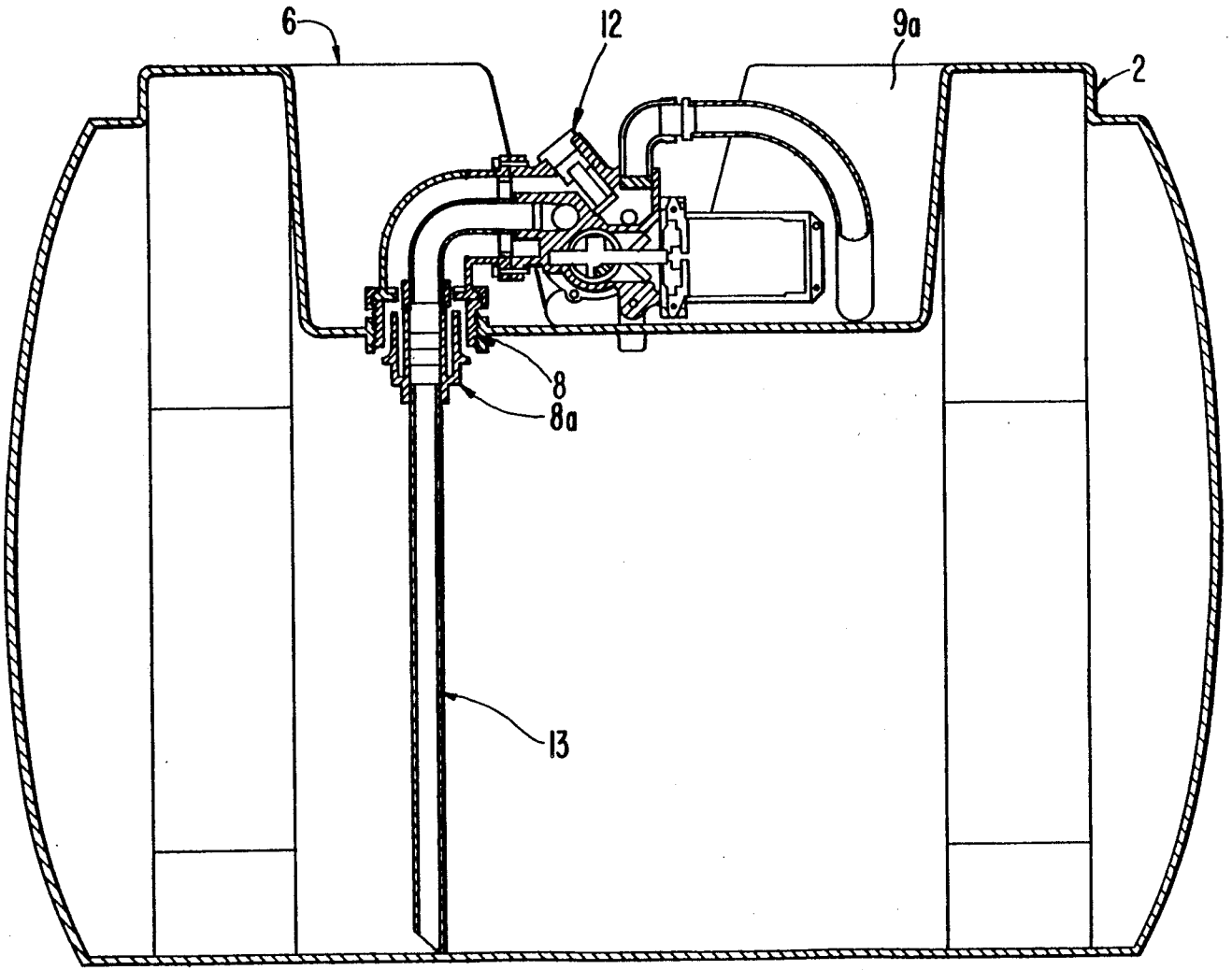
FIG. 8 is a schematic diagram of the present invention illustrating a pump operatively connected thereto.

The chemical handling tanks according to the embodiments of the present invention also include a pump mounting assembly 8 extending in the top of the body portion 1 and through which the liquid contained in the tank can be delivered therefrom by a pump 12 (FIG. 8).

The supporting portion 2 has a central recess 9a (FIGS. 2, 5 and 8) at the bottom of which the pump mounting assembly 8 is exposed. The pump 12, when operatively connected to the pump mounting assembly 8, can be entirely received within the central recess 9a so as not to extend above the upper portion 6 of the supporting portion 2. Accordingly, when the tanks are stacked, as is quite clear from FIG. 8, the pumps 12 can remain operatively connected to the pump mounting assembly 8. It is to be noted in FIG. 8 that reference numeral 8a refers to an adaptor assembly of the pump while reference numeral 13 refers to a stand pipe through which liquid is drawn from the tank by the pump.

Furthermore, the supporting portion 2 has at least one respective side recess 9b extending between the central recess 9a and a respective side of the body portion 1 of the tank. When the tanks are stacked in the above-mentioned manner with the pump of the lowermost tank operatively connected to the pump mounting assembly 8 via the adaptor assembly 8a, the pump can be accessed through the side recess 9b.

Finally, the chemical handling tank of the present invention can be refilled through a removable bung 11.

Many changes and variations in the present invention will become apparent to those of ordinary skill in the art reviewing the present specification. The changes and variations which fall within the scope of the appended claims are seen to be embraced by the true spirit and scope of the invention and accordingly, the specification is intended to be descriptive and not limitative of the present invention.

What is claimed is:

1. A fluid handling tank comprising:

a generally hollow body portion for containing fluid therein, and a supporting portion integral with said body portion, said hollow body portion having a longitudinal axis, said supporting portion including a base for resting on a supporting surface to support said body portion thereon, said base extending laterally with respect to and to each side of said longitudinal axis of said body portion, and a respective tip-over-preventing portion extending laterally with respect to said longitudinal axis and at a predetermined angle from said base on each side of said longitudinal axis, said tip-over-preventing portion for preventing the tank from tipping over when the tank is tilted laterally with respect to said longitudinal axis about said base while resting on the supporting surface by coming into contact with the supporting surface as the tank is tilted, the longitudinal axis of said body portion extending generally horizontally when the base rests on the supporting surface, and the tank having a center of gravity that is located at a predetermined distance from with the base resting on said supporting surface, that is less than half the length of the tank as taken along said longitudinal axis of said body portion.

2. A fluid handling tank as claimed in claim 1, wherein said base comprises a pair of base portions spaced apart from one another in a direction extending along said longitudinal axis of said body portion, said base portions each extending laterally with respect to and to each side of said longitudinal axis of said body portion, and a said respective tip-over-preventing portion extends from each of said base portions on each side of said longitudinal axis.

3. A fluid handling tank as claimed in claim 1, wherein the tank including said body portion and said supporting portion comprises polyethylene.

4. A fluid handling tank as claimed in claim 1, wherein each said predetermined angle is 90°.

5. A fluid handling tank as claimed in claim 1, wherein each said respective tip-over-preventing portion has at least one groove extending therein and open to a respective side of the tank for defining at least one grooved portion on each side of the tank in which flexible hoisting line can be securely fitted around the tank to allow the tank to be transported.

6. A fluid handling tank as claimed in claim 5, wherein each said groove is open to the underside of the tank at a respective location adjacent said base, and further comprising a respective rib member projecting from the top of the tank above each said respective location, each said groove having a width approximately the same as the width of the rib extending thereabove whereby when respective ones of the tanks are stacked, said ribs of a lower one of the stacked tanks extend into the grooves of an upper one of the stacked tanks, respectively.

7. A fluid handling tank as claimed in claim 1, wherein each said respective tip-over-preventing portion has two parallel grooves extending therein and open to a respective side of the tank for defining at least one grooved portion comprising said two parallel grooves on each side of the tank in which flexible hoisting line can be securely fitted around the tank to allow the tank to be transported.

8. A fluid handling tank comprising:

a generally hollow body portion for containing fluid therein and having a longitudinal axis, and a supporting portion integral with said body portion and extending on respective sides of the tank that are opposite one another with respect to said longitudinal axis, said supporting portion having at least one groove extending therein on each of said respective sides of the tank for defining a grooved portion on each of said sides of the tank in which flexible hoisting line can be securely fitted around the tank to allow the tank to be transported.

9. A fluid handling tank as claimed in claim 8, wherein said hollow body portion has first and second ends spaced from one another along said longitudinal axis, and said supporting portion has a pair of grooves extending therein adjacent each of said ends of said hollow body portion, each of said pair of grooves located on a respective one of said sides of said tank and extending in a plane perpendicular to said longitudinal axis.

10. A fluid handling tank as claimed in claim 9, wherein at least a portion of each of said grooves has the bottom thereof defined by a respective surface of the supporting portion that extends inwardly toward the underside of the tank and obliquely with respect to said longitudinal axis.

11. A fluid handling tank as claimed in claim 8, wherein each of said grooves is open to the underside of the tank at a respective location, and further comprising a respective rib projecting from the top of the tank above each said respective location, each of said grooves having a width approximately the same as the width of the rib extending thereabove whereby when respective ones of the tanks are stacked, said ribs of a lower one of the stacked tanks extend into the grooves of an upper one of the stacked tanks, respectively.

12. A fluid handling tank as claimed in claim 9, wherein each of said grooves is open to the underside of the tank at a respective location, and further comprising a respective rib projecting in a respective one of said planes from the top of the tank above each said respective location, each of said grooves having a width approximately the same as the width of the ribs extending thereabove whereby when respective ones of the tanks are stacked, said ribs of a lower one of the stacked tanks extend into the grooves of an upper one of the stacked tanks, respectively.

13. A chemical handling tank as claimed in claim 8, wherein said supporting portion has at least one pair of spaced-apart recesses defined therein and in which the fork of a forklift is insertable.

14. A fluid handling tank comprising:

a generally hollow body portion for containing fluid therein, and a supporting portion integral with said body portion, said supporting portion comprising a base extending along the bottom of said body portion for supporting said body portion on a support surface and an upper portion extending along the top of said body portion opposite said base, said supporting portion having at least one groove extending therein open, at a respective location, to the underside of the tank, and a respective rib projecting from said upper portion of the supporting portion directly above each said respective location, each said groove having a width at said respective location approximately the same as the respective rib extending thereabove whereby when respective ones of the tanks are stacked, each said rib of a lower one of the stacked tanks extends into a said groove of an upper one of the stacked tanks, respective, and a pump mounting assembly extending in the top of said body portion, adapted to operatively connect a pump to the tank, and through which pump mounting assembly the liquid contained in the tank is deliverable by a pump, the upper portion of said supporting portion having a central recess therein at the bottom of which said pump mounting assembly is exposed, said recess being of a sufficient depth to receive a pump entirely therein when a pump is operatively connected to said pump mounting assembly.

15. A fluid handling tank as claimed in claim 14, wherein said supporting portion also extends along each side of said hollow body portion between the top and bottom thereof, said at least one groove comprises at least one pair of grooves each of which extends in said supporting portion at a respective side of said hollow body portion for defining a grooved portion at each side of the tank in which flexible hoisting line can be firmly fitted around the tank to allow the tank to be transported, said base extending between the locations at which each of said pair of grooves is open to the underside of the tank.

16. A fluid handling tank as claimed in claim 15, wherein said base includes a pair of spaced apart base portions, said at least one pair of grooves comprises two pairs of grooves, each of said base portions extending between a respective said pair of grooves.

17. A fluid handling tank as claimed in claim 14, wherein each said at least one groove extends in said base.

18. A fluid handling tank as claimed in claim 17, wherein said base comprises a pair of spaced apart base portions, and said at least one groove comprises a pair of grooves each of which extends in a respective one of said pair of base portions.

19. A fluid handling tank as claimed in claim 14, wherein said supporting portion has at least one respective side recess extending therein between and open to said central recess and a respective side of said body portion for allowing access to a pump when a pump is operatively connected to said pump mounting assembly in the central recess of the lower one of the stacked tanks.

20. A fluid handling tank as claimed in claim 1, wherein said tank is normally closed to the ambient environment and comprises a removable bung means for allowing the tank to be refilled with fluid.

21. A fluid handling tank as claimed in claim 1, wherein the center of gravity of said tank remains located directly over said base, in a direction perpendicular to a planar support surface, when the tank is tilted laterally with respect to said longitudinal axis about said base while resting on the planar support surface and said tip-over-preventing means contacts the planar supporting surface.

22. A fluid handling tank as claimed in claim 14, wherein said tank further comprises a removable bung means disposed at the bottom of said central recess for allowing the tank to be refilled with liquid.

23. The fluid handling tank as claimed in claim 1, wherein said generally hollow body portion is generally cylindrical and the longitudinal axis thereof extends parallel to said base.

24. The fluid handling tank as claimed in claim 23, wherein said tank is normally closed to the ambient environment and comprises a removable bung means for allowing the tank to be refilled with fluid.

25. The fluid handling tank as claimed in claim 24, wherein said body portion and said supporting portion are a one-piece structure.

26. The fluid handling tank as claimed in claim 8, wherein said hollow body portion has first and second ends spaced from one another along said longitudinal axis, said supporting portion also includes a base extending below said body portion for resting on a supporting surface to support said body portion thereon, said supporting portion has a pair of grooves extending therein at each of the respective sides of the tank and defines a said grooved portion on each of the sides of the tank in which the grooves of each said pair are located adjacent the ends of said hollow body portion, respectively, the grooved portion on each of the sides of the tank extending laterally from said base with respect to said longitudinal axis and with a predetermined angle therebetween so as to define a pair of recesses between each said grooved portion and said base that are able to accommodate the fork of a conventional forklift, said recesses being located directly below and open to the grooves extending in said supporting portion, respectively, whereby a single flexible hoisting line may extend, from a location above the tank, into a respective one of said grooves that is open at one of the sides of the tank and is adjacent one of the ends of said body portion, through the recess located directly below said one of said grooves, over said one of the ends of said body portion, into a respective another of said grooves that is open at the other of the sides of the tank and is adjacent said one of the ends of said body portion, via the recess located directly therebelow, and to said location.

* * * * *